US008956314B2

(12) United States Patent
Yeo et al.

(10) Patent No.: US 8,956,314 B2
(45) Date of Patent: Feb. 17, 2015

(54) PORTABLE MASSAGE DEVICE

(75) Inventors: Poh Teck Yeo, Singapore (SG); Poh Seng Yeo, Singapore (SG); Kai How Seet, Singapore (SG); Che Ooi Chiou, Singapore (SG)

(73) Assignee: Vibrasys Pte. Ltd., Singapore (SG)

( * ) Notice: Subject to any disclaimer, the term of this patent is extended or adjusted under 35 U.S.C. 154(b) by 1153 days.

(21) Appl. No.: 12/675,912

(22) PCT Filed: Apr. 30, 2008

(86) PCT No.: PCT/SG2008/000153

§ 371 (c)(1),
(2), (4) Date: Mar. 1, 2010

(87) PCT Pub. No.: WO2009/029050

PCT Pub. Date: Mar. 5, 2009

(65) Prior Publication Data

US 2010/0234778 A1 Sep. 16, 2010

(30) Foreign Application Priority Data

Aug. 29, 2007 (SG) ..... 200706338-1

(51) Int. Cl.
*A61H 1/00* (2006.01)
*A61H 23/02* (2006.01)

(52) U.S. Cl.
CPC ..... *A61H 23/0254* (2013.01); *A61H 23/0263* (2013.01); *A61H 2201/0169* (2013.01); *A61H 2201/1642* (2013.01); *A61H 2201/165* (2013.01); *A61H 2201/50* (2013.01); *A61H 2201/5035* (2013.01); *A61H 2201/5038* (2013.01); *A61H 2205/102* (2013.01)
USPC ..... 601/48

(58) Field of Classification Search
CPC ..... A61H 15/0078; A61H 15/0092; A61H 2015/0014; A61H 2015/0035; A61H 23/0254
USPC ..... 601/65, 46, 70–72, 48, 74, 78
See application file for complete search history.

(56) References Cited

U.S. PATENT DOCUMENTS

| | | | | |
|---|---|---|---|---|
| 2,235,183 | A * | 3/1941 | Wettlaufer | 601/65 |
| 2,742,036 | A * | 4/1956 | Montesano | 601/71 |
| 5,575,761 | A * | 11/1996 | Hajianpour | 601/48 |
| 7,348,702 | B2 * | 3/2008 | Melfi | 310/153 |
| 2003/0060739 | A1 | 3/2003 | Connor et al. | |
| 2004/0133133 | A1 | 7/2004 | Driemann et al. | |
| 2007/0197941 | A1 | 8/2007 | Koen | |

FOREIGN PATENT DOCUMENTS

| | | |
|---|---|---|
| WO | WO 97/10794 | 3/1997 |

* cited by examiner

*Primary Examiner* — Kevin C Sirmons
*Assistant Examiner* — Pritesh Patel
(74) *Attorney, Agent, or Firm* — Enshan Hong; Kent H. Cheng; VLP Law Group LLP

(57) ABSTRACT

A portable massage device and method for reducing soreness in muscles or joints. The device includes a cage having a plurality of ventilation apertures that assist in cooling an internal motor.

19 Claims, 5 Drawing Sheets

PORTABLE MASSAGE DEVICE

This is a U.S. national stage of application No. PCT/SG2008/000153, filed on Apr. 30, 2008, which claims priority to the Singapore Application No.: 200706338-1, filed Aug. 29, 2007, the contents of both being incorporated herein by reference.

FIELD OF THE INVENTION

The present invention relates to a massage device designed to alleviate pain or stiffness of the joints, skin and/or tendons of a user.

BACKGROUND OF THE INVENTION

The physiological blocking of pain may be accomplished by a mechanism known as presynaptic inhibition, which decreases the sensory input to the first relay neuron of the spinal cord. Medications, heat treatment, ultra sound therapy and vibration may be used to obtain pain relief. Where mechanical vibration is used to treat pain relief, the vibratory devices used are often subject to overheating from prolonged usage, or being of inadequate size for an intended target area of the body.

There are four main types of mechanoreceptors in the glabrous skin of humans: Pacinian corpuscles, Meissner's corpuscles, Merkel's discs, and Ruffini corpuscles. The main mechanoreceptors in the joints are Pacinian corpouscles and Merkel's discs. Conventional devices used by physiotherapists typically provide an electrical stimulation which just stimulates the nerve. Different joints often require different stimulating amplitude and/or frequency. In particular, frequency variations targeted for a specific mechanoreceptor type provides additional effectiveness for alleviating stiffness and pain.

SUMMARY OF THE INVENTION

The present invention in one preferred aspect provides for a portable massage device for reducing soreness in muscles or joints, the device comprising a motor adapted to produce vibrations; a cage having an interior sized to contain the motor, the cage including a plurality of ventilation apertures; and a carrying device adapted to be worn by a user, the carrying device being configured to fasten the cage to the user.

In another preferred aspect, the present invention provides a method for reducing soreness in a muscle or joint of a user, the method comprising attaching a device having a vibratory motor to a target area on an exterior portion of the user; determining the type of mechanoreceptor at the target area; selecting an amount of vibration to impart to the target area based on the type of mechanoreceptor; and imparting the selected amount of vibration to the target area.

DETAILED DESCRIPTION OF THE DRAWINGS

Alternative embodiments of the invention will be apparent to those skilled in the art from consideration of the specification and practice of the invention disclosed herein. It is intended that the specification and examples be considered as exemplary only, with a true scope and spirit of the invention being indicated by the claims which fallow.

Figure 5:
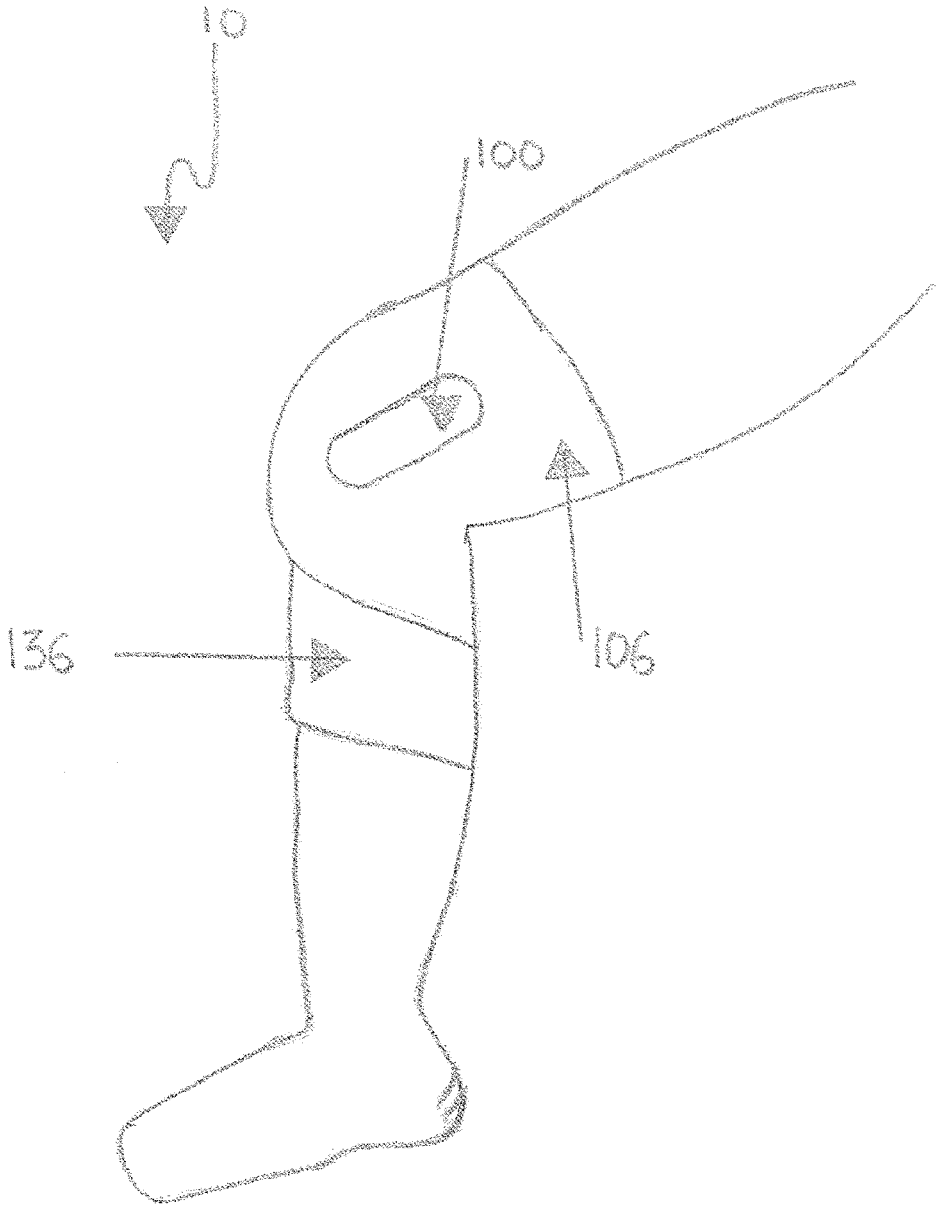
FIG. 5 is a side elevation view of the unit of FIG. 1 attached to a carrying means and being worn around the knee region of a user.

FIGS. 1 to 5 show a preferred embodiment of a portable massage device 10 having a vibration unit 100 with a cage 102 and a matter assembly 104, and a carrying device 106 (FIG. 5). The preferred elements of the device and their interrelationship are described below.

Figure 1:
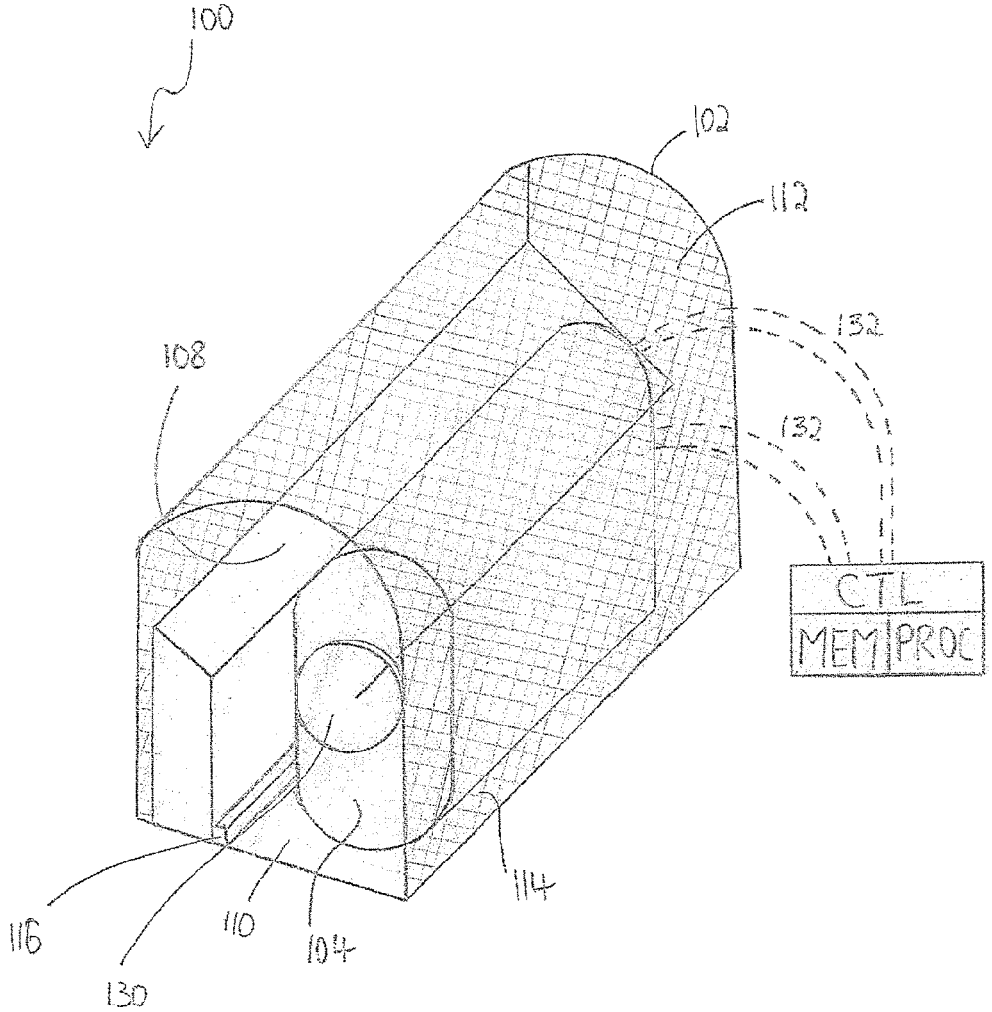
FIG. 1 is a partial perspective view of a vibration unit of a portable massage device with a cage and a motor assembly in accordance with a preferred embodiment of the present invention.

FIG. 1 is not drawn to scale and it shall be noted that the entire assembly may be of different shapes and sizes suitable far the various target areas of application an the human body.

Figure 2:
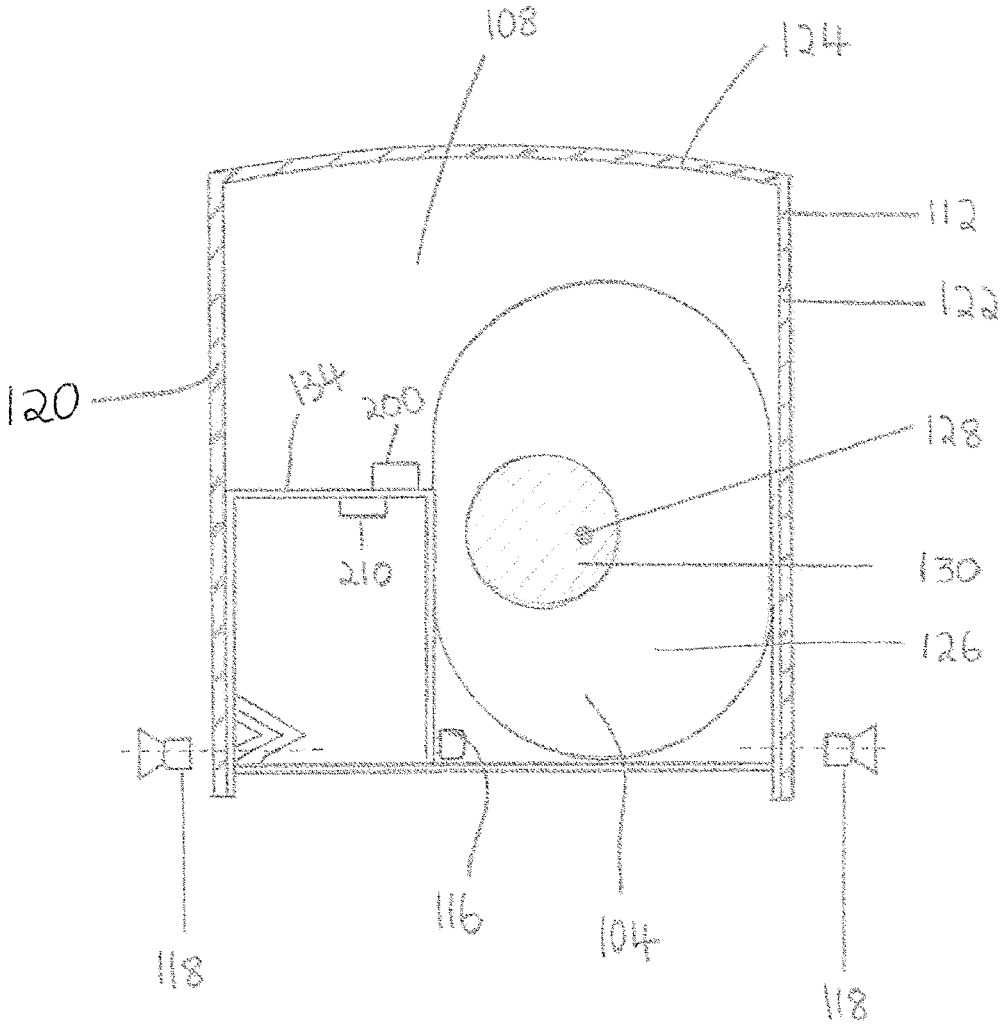
FIG. 2 is a cross sectional side view of the unit of FIG. 1.
Figure 3:
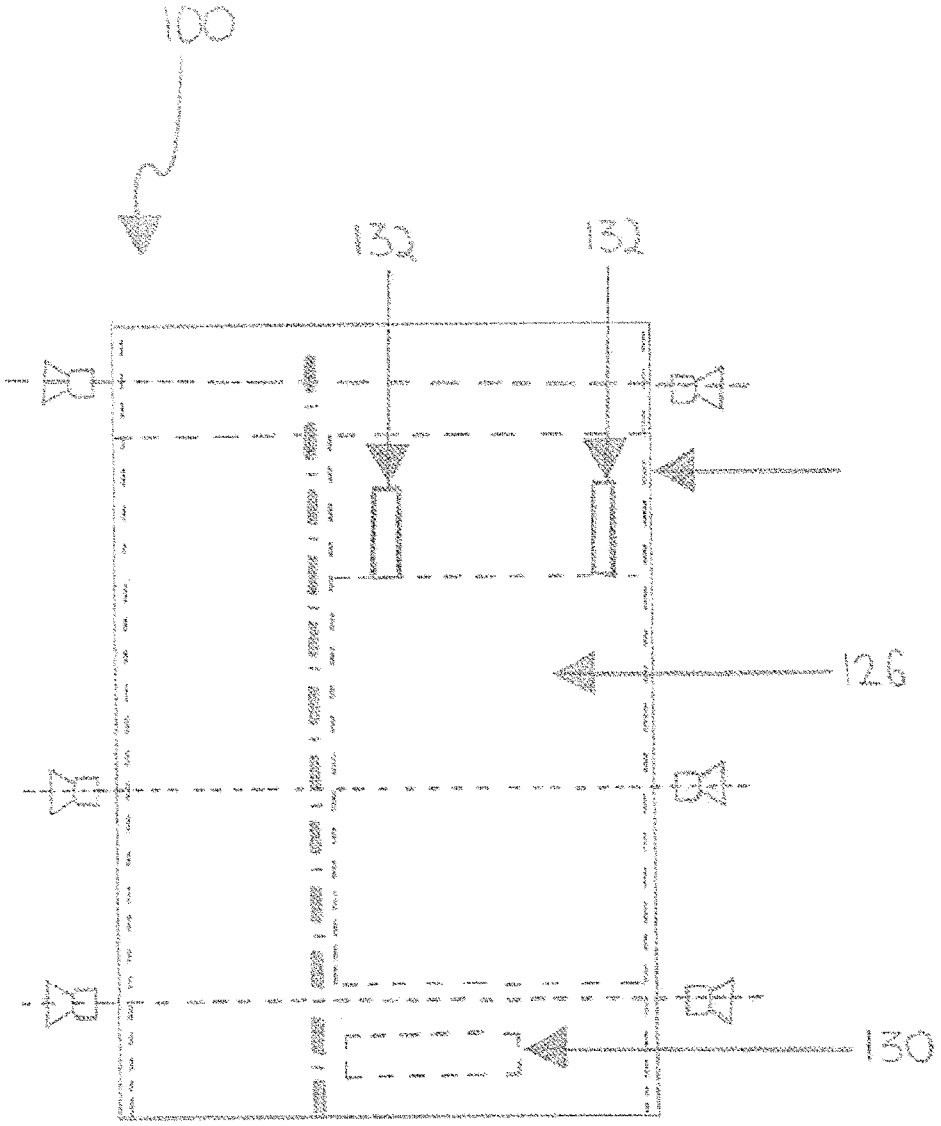
FIG. 3 is a top plan view of the unit of FIG. 1, with portions of the motor assembly shown in dashed outline.
Figure 4:
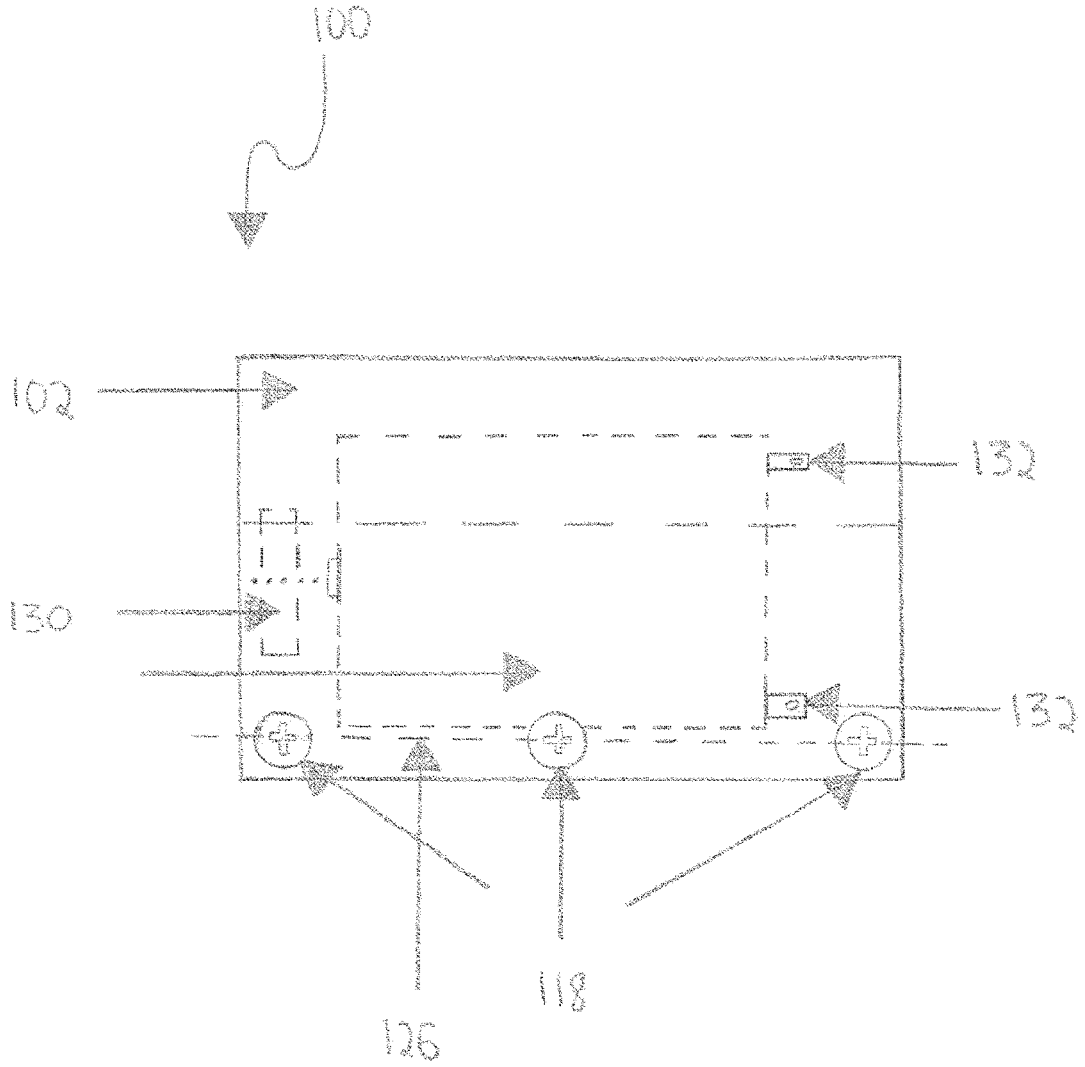
FIG. 4 is a side elevation view of the unit of FIG. 1, with portions of the motor assembly shown in dashed outline.

Referring to FIGS. 1 and 2, cage 102 preferably includes an interior 108, a base plate 110 and a wall 112 having a plurality of ventilation apertures 114. Interior 108 is preferably sized to contain motor assembly 104 as shown in FIG. 1. Base plate 110 preferably includes a retention member or track 116 configured to maintain the position of motor assembly 104 relative to base plate 110. Wall 112 is preferably attachable to base plate 110 via one or mare fasteners, such as screws 118 shown in FIG. 2. It will be appreciated that other types of fasteners may be used, or the wall may be formed integrally with the base plate, if desired.

As shown in FIG. 2, wall 112 preferably includes opposed generally parallel side portions 120, 122 and a curved upper surface 124. Wall 112 may further include front and rear walls (not shown) connecting side portions 120, 122. Preferably wall 112 is constructed from a light, bendable, breathable, durable material, such as a thin metal fail, plastic, or other flexible polymer material. The shape, thickness and material of wall 112 may be varied as appropriate without departing from the scope of the present invention.

Referring still to FIG. 1, ventilation apertures 114 are preferably spread throughout the entire sides, front, back and upper surface of wall 112. As will be appreciated, the placement, shape and number of apertures may be varied as appropriate.

For example, wall 112 may include only one or two apertures, or none at all depending upon the intended use of the unit. Apertures of different size and configuration may be used as desired.

As shown in FIGS. 1 and 2, motor assembly 104 preferably includes a motor 126, an axle 128, an eccentric load preferably in the form of a fly wheel 130, and a power connection 132. The motor 126 is adapted to produce controlled variations. Motor 126 is preferably a variable speed motor driven by a 9 to 12 Volt DC source. When supplied with energy through power connection 132, motor 126 will rotate axle 128, which in turn rotates fly wheel 130 to cause vibration unit 100 to vibrate. Referring to FIG. 2, fly wheel 130 is preferably offset relative to the central axis of axle 128. Fly wheel 130 may be configured to provide a desired vibration as appropriate for a given motor. Preferably, motor assembly 104 will provide a vibration frequency in the range of 50 to 300 Hertz, more preferably 50 to 150 Hertz. Preferably, fly wheel 130 is shaped so that the rotation of fly wheel 130 will create an air disturbance within interior 108 of cage 102, further acting to cool motor 126 when in use. To enhance the ability of fly wheel 130 to produce an air disturbance, one or more projections such as flanges or paddles may be included on fly wheel. The projections may be configured to produce an air flow through cage 102.

Power connection 132 preferably connects motor 126 to a control device. The control device may include one or more power sources such as a conventional DC motor and/or DC 9V or 12V battery. Alternatively, power connection 132 may connect motor 126 to a power source configured to be worn by the user, such as a battery.

The control device is preferably programmable by the user. For example, the control device may include a memory and processor that permits the user to program start and stop times, duration, and vibration frequency. The programmable memory may further include information specific to the type of target area where the device is intended to be used. For example, the memory may contain a preferred vibration frequency range for a type of mechanoreceptor. Upon entry of the mechanoreceptor type, or an intended target area, the control device may automatically select a vibration frequency range appropriate for the intended target area and/or mechanoreceptor type.

Motor 126 is preferably positioned on base plate 110 so that no portion of motor 126 contacts wall 112. Such a configuration reduces damping, and consequently reduces the heat produced by motor 126. If desired, an optional spacer 134 may be positioned proximate motor 126 on base plate 110.

FIG. 5 shows massage device 10 being worn in the knee area of a user as an example of the typical application of the device. As shown in FIG. 5, vibration unit 100 is preferably attached to carrying device 106, which is preferably configured to the geometry of the target area. Carrying device 106 may be formed out of a cloth material and configured as either as a sleeve or a wrap-around bandage with a securing means such as, but not limited to Velcro™, snaps, buttons, and a zipper. It will be appreciated that the carrying device 106 may take other forms as appropriate for the intended target area. For example only, the carrying device 106 may be formed as a waist belt or ankle boot.

Carrying device 106 preferably includes a platform configured for engagement with base plate 110 to permit vibration unit 100 to be detachable from carrying device 106. The platform may be adapted to rotate about a vertical axis and/or move vertically or angularly relative to the vertical axis. If desired, device 10 may further include a cover 136 adapted to separate a portion of vibration unit 100 and/or the platform from the skin of the user. Cover 136 may be configured to lie over a portion or all of cage 102 to dampen the noise produced when the device is in use. Cover 136 is preferably made of a soft fabric such as a tube gauze or silk material that allows sufficient ventilation while damping noise and generally preventing skin abrasion from the vibrations.

Having described the preferred components the portable massage device, a preferred method of use will now be described with reference to FIGS. 1 and 5. A user desirous of reducing soreness in a muscle or joint selects an appropriate carrying device 106 for the target area. Device 10 is attached to a platform on the carrying device 106, which is then worn by the user. The type of mechanoreceptor at the target area is determined and the vibration frequency is selected based on the type of mechanoreceptor. The selected vibration frequency is then imparted to the target area.

If desired, the vibration unit may be detached from one carrying device 106 and re-attached to a carrying device 106 configured for another target area. The steps described above may be repeated at the new target area as appropriate. The method may include contacting a plastic portion of the cage with the target area if using a cage having a portion which is plastic. The method may further include permitting the motor to be ventilated through the cage.

When used with a programmable controller, the user may input the identity of the target area and/or mechanoreceptor type (if known) into the controller. The controller may then determine an appropriate vibration frequency specific to the target area and/or mechanoreceptor type and set the motor so that when activated, the motor will be at the appropriate vibration frequency. The controller may further query the user for a desired start and stop time, or a duration time. A preferred vibration frequency range is 50 to 300 Hertz, more preferably 50 to 150 Hertz. The ranges described above may include a subset of ranges therein without departing from the scope of the present invention. Parameters stored in the memory may be preset or inputted by the user as desired.

The method described above may be applicable to areas such as, but not limited to the wrist, knee, ankle, waist, neck, lower back, elbow, foot and any other area of the body where the user is experiencing soreness or pain in the muscles, joints and/or skin. The present invention may be used in therapeutic applications, overcoming muscle soreness and leg swelling for long flights and other prolonged seating situations as well as inhibit blood coagulation, which may otherwise lead to thrombosis. The present invention may, if desired, be used as a substitute for pain reduction where appropriate such as for minor procedures comprising local injections and the like.

It will be appreciated that the steps described above may be performed in a different order, varied, or omitted entirely without departing from the scope of the present invention.

The foregoing description is by way of example only, and may be varied considerably without departing from the scope of the present invention. For example only, a remote control may be utilized instead of or in addition to power connection 132. The device 100 may include a temperature sensor 200 and auto-shut off 210 in the event that the temperature of the motor reaches an unsafe level. The platform may be omitted from the carrying means so that base plate 110 of vibration unit 100 may directly contact the skin of the user. The carrying means may include multiple platforms for multiple vibration units. The vibration unit may include a self-contained power source such as a battery. Alternatively, the carrying means may be adapted to carry one or more power sources, and/or the power sources may be attached to the vibration unit with a cord.

The features described with respect to one embodiment may be applied to other embodiments, or combined with or interchanged with the features other embodiments, as appropriate, without departing from the scope of the present invention.

The present invention in a preferred form provides many advantages. For example only, in a preferred form the motor is cooled by the ventilation apertures, the air current produced by the fly wheel, and by the reduction in any damping that would otherwise be present if the motor were directly in contact with the cage wall. The enhanced cooling properties of a preferred configuration of the present invention permit a smaller size motor to be utilized, which in turn permits the present invention to be adapted to a greater variety of target areas. A smaller sized motor also adds to the comfort of the user, which may grow fatigued from carrying a larger motor. Increased usage time may also be obtained since the risk of overheating is reduced.

Other advantages of a preferred form of the present invention include the ability to specifically target and reduce soreness and pain based on the type of target area and/or mechanoreceptor type, which provides a more effective reduction of the soreness and pain.

The size of a preferred form of the present invention permits greater flexibility for the user to move about and allows the user to use a single vibration unit for more than one target area.

It will of course be realized that the above has been given only by way of illustrative example of the invention and that all such modifications and variations thereto as would be apparent to persons skilled in the art are deemed to fall within the broad scope and ambit of the invention as herein set forth.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The claims defining the invention are as follows:

1. A portable massage device for reducing soreness in muscles or joints, the device comprising:

a motor adapted to produce vibrations, said motor comprising an axle having an eccentric load;

a cage having an interior sized to contain said motor, said cage including a plurality of ventilation apertures;

a carrying device adapted to be worn by a user, said carrying device being configured to fasten said cage to the user; and a control means for controlling the output of said motor comprising a memory containing a vibration frequency range programmed therein for a type of mechanoreceptor;

wherein the eccentric load comprises a fly wheel shaped so that the rotation of the fly wheel produces an air disturbance.

2. The device of claim 1, wherein said cage is formed from a metallic material.

3. The device of claim 1, wherein said cage includes a thin foil wall.

4. The device of claim 1, wherein said cage is formed from a plastic material.

5. The device of claim 1, further comprising an outer cover adapted to separate a portion of said cage from the user while the device is being used by the user.

6. The device of claim 1, wherein said carrying device includes a platform, said cage being detachable from said platform.

7. The device of claim 1, further comprising a power source adapted to be carried by said carrying means.

8. The device of claim 1, wherein the fly wheel comprises a projection to enhance air disturbance of the fly wheel in rotation.

9. The device of claim 3, wherein the cage has a base plate and the motor is positioned on the base plate and is not in direct contact with the thin foil wall.

10. The device of claim 1, wherein said control means is programmable by a user.

11. A method for reducing soreness in a muscle or joint of a user, the method comprising:

(a) attaching the device of claim 1 to a target area on an exterior portion of the user;

(b) determining the type of mechanoreceptor at the target area;

(c) selecting an amount of vibration to impart to the target area based on the type of mechanoreceptor; and (d) imparting the selected amount of vibration to the target area.

12. The method of claim 11, wherein the device is attached to a carrying device adapted to be worn by the user for placement against the target area, further comprising detaching the device from the carrying device and attaching the device to a different carrying device adapted for placement against another target area on an exterior portion of the user.

13. The method of claim 11, further comprising repeating steps (a) to (d) for a different target area on an exterior portion of the user.

14. The method of claim 11, wherein the motor is contained within a cage, a portion of which is plastic, further comprising contacting the plastic portion of the cage with the target area.

15. The method of claim 11, wherein the motor is contained within a cage, further comprising permitting the motor to be ventilated through the cage.

16. The method of claim 12, further comprising repeating steps (a) to (d) for a different target area on an exterior portion of the user.

17. The method of claim 12, wherein the motor is contained within a cage, a portion of which is plastic, further comprising contacting the plastic portion of the cage with the target area.

18. The method of claim 12, wherein the motor is contained within a cage, further comprising permitting the motor to be ventilated through the cage.

19. The device of claim 2, wherein said cage includes a thin foil wall.

* * * * *